United States Patent [19]

Okada

[11] 4,218,149

[45] Aug. 19, 1980

[54] WIRE PRINTER

[75] Inventor: Mutsumi Okada, Tokyo, Japan

[73] Assignee: Kabushiki Kaisha Seikosha, Kyobashi, Japan

[21] Appl. No.: 898,771

[22] Filed: Apr. 21, 1978

[30] Foreign Application Priority Data

Apr. 22, 1977 [JP] Japan ..... 52/46386

[51] Int. Cl.[2] ..... B41J 3/12

[52] U.S. Cl. ..... 400/124; 101/93.05

[58] Field of Search ..... 400/124; 101/93.05, 101/93.04

[56] References Cited

U.S. PATENT DOCUMENTS

| | | | |
|---|---|---|---|
| 2,728,289 | 12/1955 | Johnson et al. | 400/124 X |
| 2,773,443 | 12/1956 | Lambert | 101/93.05 |
| 3,742,846 | 7/1973 | Knappe | 400/124 X |
| 3,837,460 | 9/1974 | Chida et al. | 101/93.05 X |
| 4,024,506 | 5/1977 | Spaargaren | 400/124 X |
| 4,077,336 | 3/1978 | Talvard | 400/124 X |

FOREIGN PATENT DOCUMENTS

| | | | |
|---|---|---|---|
| 2553762 | 6/1977 | Fed. Rep. of Germany | 400/124 |

*Primary Examiner*—Paul T. Sewell

*Attorney, Agent, or Firm*—Robert E. Burns; Emmanuel J. Lobato; Bruce L. Adams

[57] ABSTRACT

A wire printer comprising a wire guide block provided with a plurality of print wires and a wire drive block providing individual electromagnet devices for independently driving the print wires. The wire drive block is installed on a base frame so as to be stationary thereon and the wire quide block is movable over the base frame in a direction transverse to the direction of advance of a paper to be printed on. The print wires are slidably supported and maintained straight by guide members which are mounted on a carriage of the wire guide block. The print wires are not deformed at all, even during printing.

2 Claims, 6 Drawing Figures

WIRE PRINTER

BACKGROUND OF THE INVENTION

The present invention relates to a wire printer of the dot-matrix type suitable for printing characters or the like at high speed.

A conventional wire printer head of the dot-matrix type generally comprise a wire guide block slidably supporting a plurality of print wires and a wire drive block provided with a plurality of electromagnet devices for each impacting individual print wires against an inked ribbon in front of a paper, and both of these blocks are connected in an assembly on a cariage reciprocatably supported. The electromagnet devices are selectively operated while the whole of the printer head reprocates in the horizontal direction transverse to the advancing direction of a paper in order to forme the desired characters or the like by the dot-matrix.

Consequently, in conventional wire printers, various problems arise according to the increment of the number of print wires. That is to say, the weight as well as the inertia of the reciprocated portion augment, and the mechanism for reciprocating the printer head becomes in large, and it becomes difficult to reciprocate it at high speed, and furthermore large vibration and sound occur when the printer head reciprocates.

SUMMARY OF THE INVENTION

It is a principal object of the present invention to provide a wire printer of the dot-matrix type suitable for printing characters or the like at high speed.

Another object of the present invention is to eliminate the disadvantages of conventional wire printers.

A wire printer accoreding to the present invention comprises a wire guide block slidably supporting a plurality of print wires and a wire drive block providing with individual electromagnet devices for each impacting individual print wires against an inked ribbon in front of an elongated paper, and charaterizes that only the wire guide block reciprocates in the horizontal direction transverse to the advancing direction of a paper, and that the wire drive block is mounted in opposition to the wire guide block on a fixed base frame and the electromagnet devices are simply operated at the stationary position.

BRIEF DESCRIPTION OF THE DRAWING

Other features and advantages of the wire printer will appear from the following description of an embodiment of the present invention, the novel features pointed out in the appended claims and attached drawings in which;

DESCRIPTION OF THE EMBODIMENT

Figure 1:
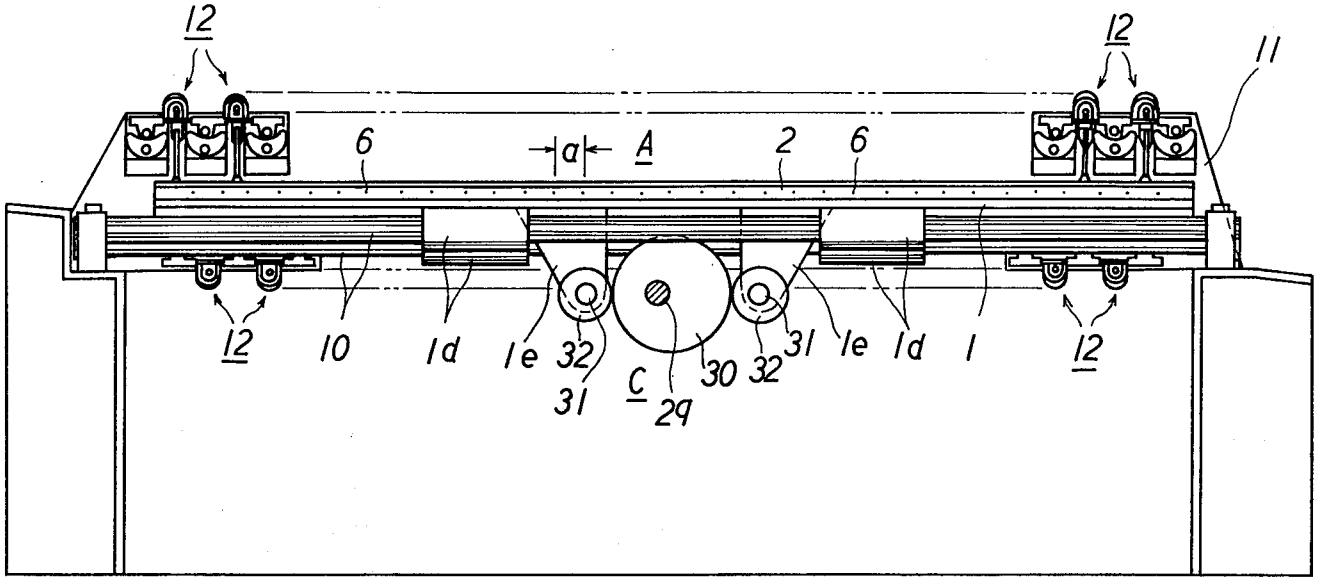
FIG. 1 is a front view of the wire printer according to the present invention.
Figure 2:
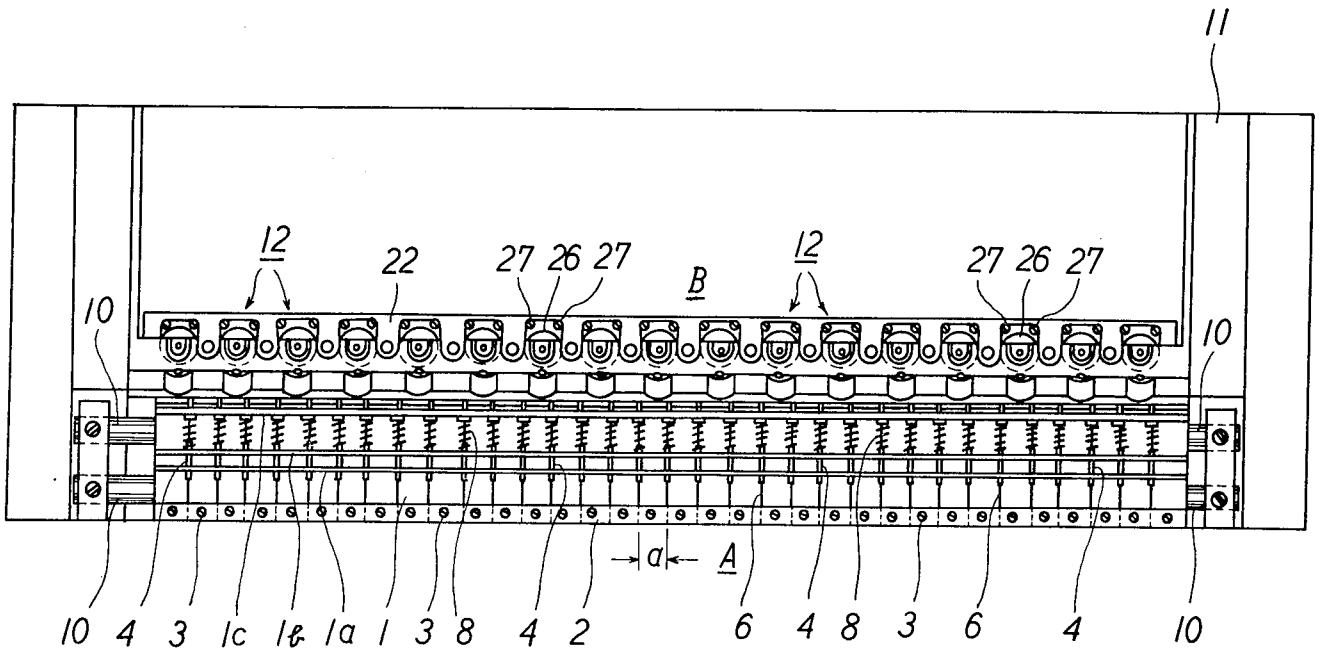
FIG. 2 is a plan view of the wire printer according to the present invention.
Figure 3:
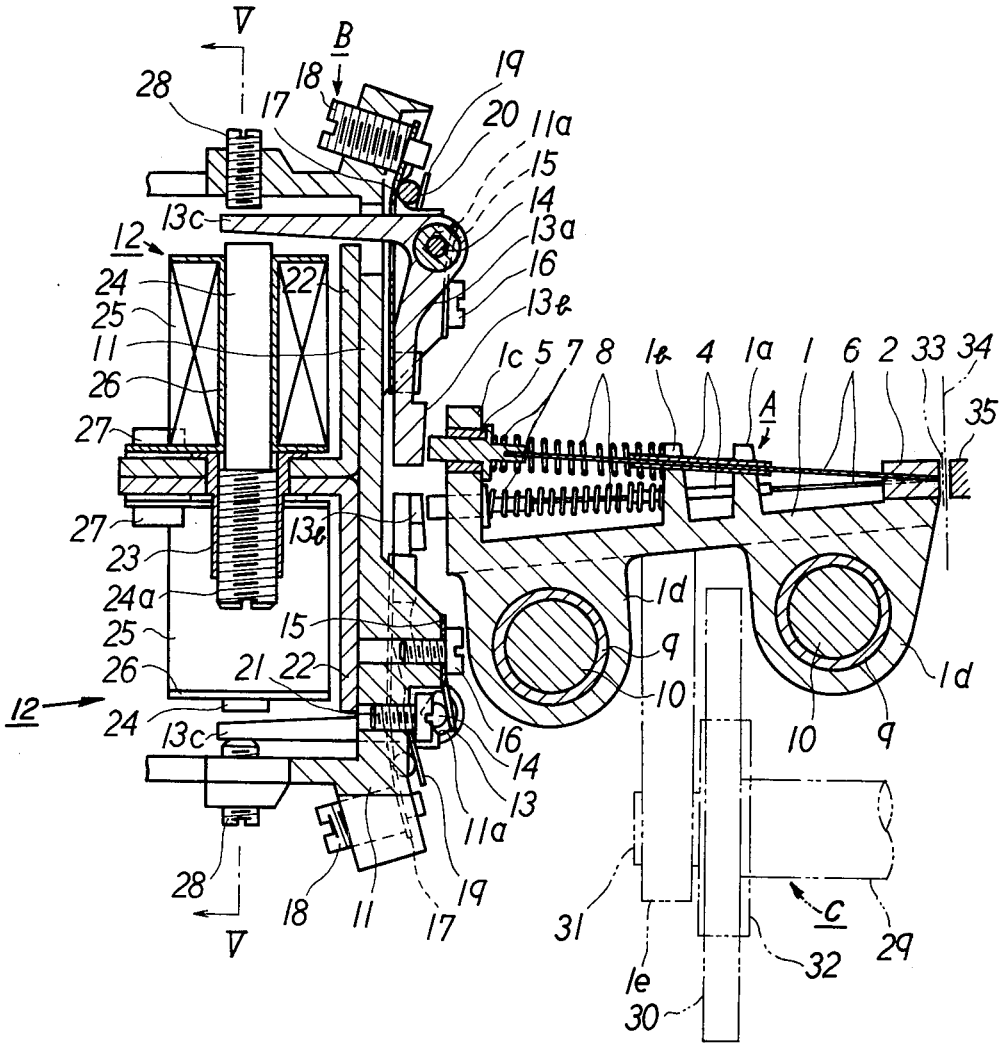
FIG. 3 is an enlarged partial vertical section view of the wire printer according to the present invention.

As shown in FIGS. 1, 2 and 3, a wire printer according to the present invention comprises a wire guide block A and a wire drive block B.

The wire guide block A is composed as follows; A carriage 1 is made of a light metal or light alloy and has projection parts 1*a*, 1*b*, 1*c* and sleeves 1*d*, 1*d* formed in a body. The carriage 1 is slidably supported on guide shafts 10 which pass through bearings 9 inserted in the sleeves 1*d*. The guide shafts 10 are fixed on a base frame 11 of the wire drive block B. An elongated guide plate 2 is fixed on the front portion (the right hand in FIG. 3) of the carriage 1 with screws 3 shown in FIG. 2. A plurality of guide pipes 4 are inserted into the projection parts 1*a* and 1*b*. Each of print wires 6 is provided with a pin 7 at its individual rear end and is slidably supported and maintained straight by the guide plate 2 and by the individual guide pipe 4. The pins 7 are slidably supported by guide bushes 5 which are inserted into the projection part 1*c* and are biased backward by restoration springs 8.

Figure 6:
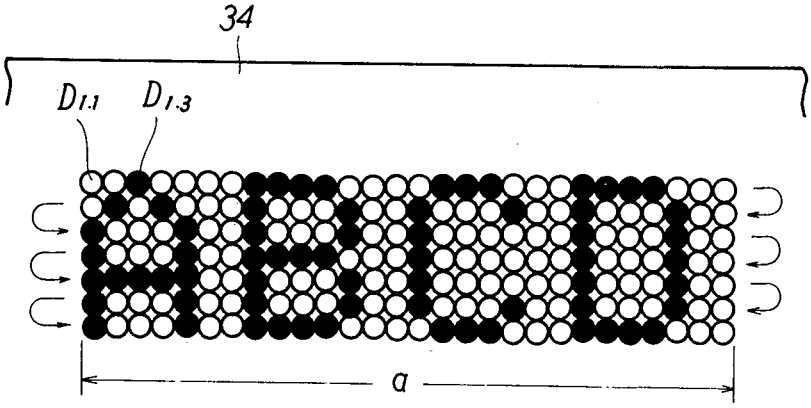
FIG. 6 is an enlarged view of some characters formed by the wire printer according to the present invention.

The number of print wires 6 is a submultiple of the total number of characters in each line and according to the present invention there are thirty-three of the print wires 6 for the case of 132 characters per line. Thirty-three print wires 6 are arranged parallel to each other at equal spaces, distance "a" corresponding to the total width of four characters and four spaces between the respective characters (Re. FIG. 6). The front ends of the print wires 6 are arranged in the direction of movement of carriage 1 and at about the same level, and the pins 7 are alternatively arranged at two different levels.

Figure 4:
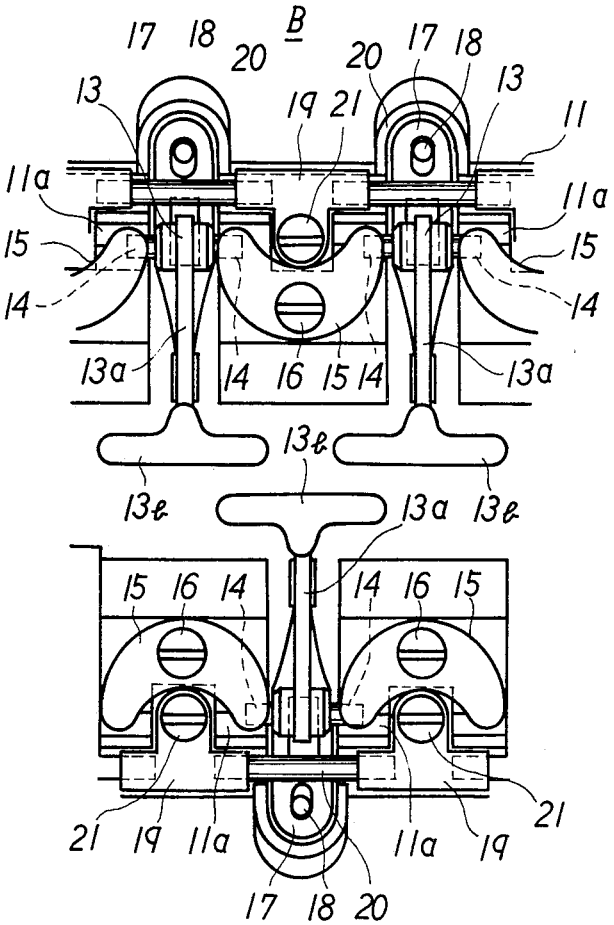
FIG. 4 is an enlarged partial front view of the drive block for the wire printer according to the present invention.
Figure 5:
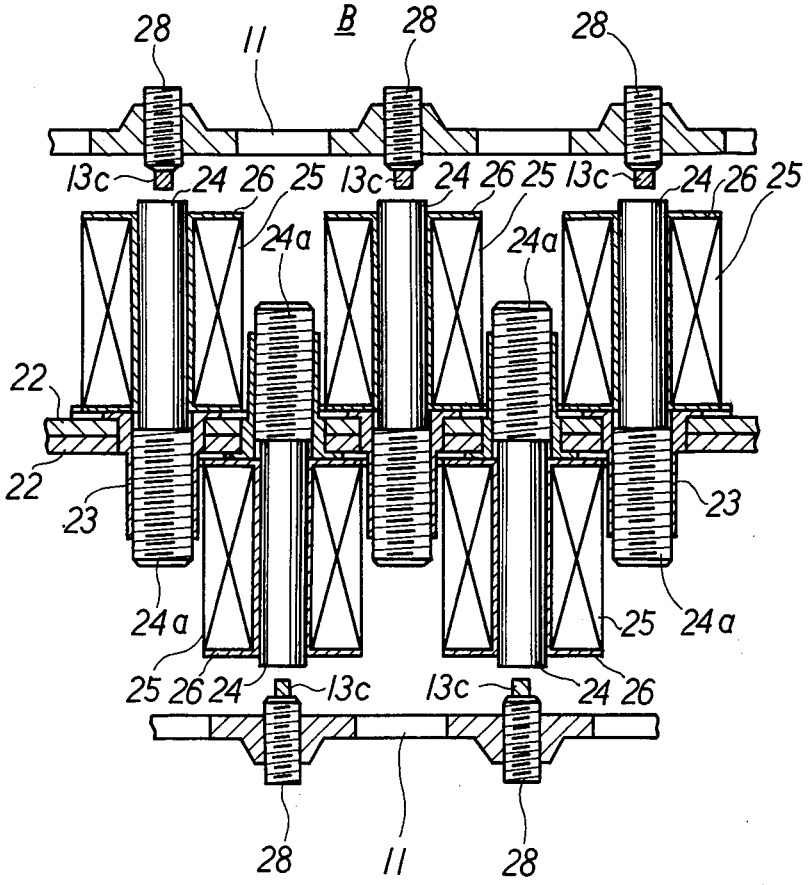
FIG. 5 is a section view taken along section line V—V in FIG. 3.

On the other hand, the wire drive block B is composed as follows; The base frame 11 is made of a non-magnetic die-cast material, and electromagnet devices 12 for individually driving the print wires 6 are mounted on this base frame. As shown in FIGS. 3 and 4, the electromagnet devices 12 for driving the pins 7 and the electromagnet devices 12 for driving the lower pins 7 are arranged in two rows in the horizontal direction and are arranged upside down with respect to each other. Each of the electromagnet devices 12 comprises an individual print lever 13, a yoke 22, an individual core 24, an individual coil 25 and other elements. Each of the print levers 13 is provided with an arm 13*a* having a horizontally elongated hitting or striking portion 13*b* at its free end and an arm 13*c* passing through the base frame 11. The length of the hitting portion 13*b* is sufficient to extend throughout the reciprocating range of the pin 7. Supporting shafts 14 of the print levers 13 are rockably supported in "V" grooves 11*a*, which are formed in a body with the base frame 11, with plate springs 15 which are fixed with screws 16 on the base frame 11. The print levers 13 are biased in the opposite direction to the driving direction by individual restoration plate springs 17. The one ends of the restoration plate springs 17 are fixed to individual arms 13*a*, and the other ends are engaged with individual screws 18 for adjusting the restoration force. The restoration plate springs 17 are elastically deformed by individual bars 20 which are fitted by individual installing plates 19 on the base frame 11, and the elastic restoration force acts as the force to bias the print levers 13. The installing plates 19 are fixed with individual screws 21 on the base frame 11. Elongated yokes 22 of "L" shape section, providing with bushes 23, are fixed on the reverse face of the base frame 11. The cores 24 are screwed into individual threads 24*a* of the bushes 24, and it is possible to adjust the air gap between the arm 13*c* and the core 24 by turning the core 24 with a screwdriver (not shown), and each core 24 extends pass through an individual bobbin 26 on which an individual coil 25 is wound. The bobbins 26 are placed to fix with screws 27 on the yokes 22. Screws 28, which are for adjusting the air gap between the pins 7 and the hitting portions 13*b*, are screwed into the base frame 11. The arms 13*c* are in contact with the screws 28 by the force of restoration plate spring 17 so that the rest position of print levers 13 is determined.

Means C for reciprocating the wire guide block A along the guide shafts 10 is composed as follows; As shown in FIG. 1 and 3, a cam-shaft 29, driven in only one angular direction by a pulse motor (not shown), is provided with a eccentric cam 30. A pair of followers 32, rotatably supported on individual shafts 31 each of which is fixed on legs 1*e*, 1*e* of the carriage 1, are in contact with the eccentric cam 30 on the horizontal line across the center of the cam shaft 29. The cariage 1, that is to say, the wire guide block A makes one reciprocation every time the eccentric cam 30 makes one revolution. The range of reciprocation of the wire guide block A is equal to or longer than the distance "a".

Furthermore, as shown in FIG. 3, an inked ribbon 33 and a paper 34 are disposed between the guide plate 2 and a fixed elongated platen 35. The paper 34 is advanced upwardly, preferably at a constant rate, by the paper feed means (not shown).

In FIG. 1, the cam shaft 29 is driven by said motor and the wire guide block A reciprocates leftward and rightward. Now, suppose that one of the print wires 6 transfers rightward from the starting position $D_{1,1}$ on the paper 34 in FIG. 6. When this print wire 6 transfers to the desired position, for example a dot position $D_{1,3}$, a current pulse is applied to the coil 25 of the electromagnet device 12 corresponding to this print wire 6 and the core 24 is magnetized. The arm 13*c* is attracted by the core 24, so that the print lever 13 rotates in opposition to the restoration plate spring 17 and the hitting portion 13*b* hits the pin 7. The print wire 6 slides forward in opposition to the force of restoration spring 7 and its front end impacts the inked ribbon 33 against the paper 34. Thus a dot is formed at the position $D_{1,3}$ of the paper 34. In the same way as described above, the electromagnet device 12 is operated at the appropriate timing while the print wire 6 transfers rightward on the paper 34, so that the first row of dots are formed one after another at the desired positions. Thereafter the print wire 6 transfers leftward on the paper 34 in FIG. 6 and the second row of dots are formed at the desired positions in the same way as described above. Successively, the reciprocation of wire guide block A, the operation of electromagnet devices 12 and the advancement of paper 34 are performed in the same way, so that the third, the fourth, and the seventh rows of dots are formed at the desired positions. In this way, one print wire 6 puts into print four characters of the seven rows five column dot-matrix as shown in FIG. 6. The same printing operation is concurrently performed in parallel by the other print wires 6, and thus the wire printer of this embodiment is able to print 132 characters per one line.

Moreover, the detection of the starting position of the print wires 6 and the applied timing of the current pulse are practiced by using a well-known detector (not shown), for example comprising a slit disk (not shown) attached to the cam shaft 29, a luminous element and a photo cell (neither of which is shown) each located on both sides of said slit disk. Further, means C is not restricted to the present embodiment and it needs no saying that it is possible to apply the other various mechanism for means C.

According to the wire printer of the present invention stated in detail above, it is possible to print the characters at high speed as the printing operation is concurrently carried out in parallel by individual print wires 6. Further, the carriage 1 of wire guide block A is provided merely with the print wires 6 which are maintained straight, and only the wire guide block A reciprocates in the horizontal direction transverse to the advancing direction of the paper 34, and the wire drive block A is only operated on the stationary position, and, in addition, the print lever 13 for applying the printing force to the print wire 6 is separated from the print wire 6 thus the weight as well as the inertia of reciprocated parts become extremely small, the vibration as well as sound become extremely small when the carriage 1 of wire guide block A reciprocates, and it is possible to reciprocate the carriage 1 at high speed as compared with conventional wire printers. Because the print wire 6 is not deformed at all even when the printing operation is carried out, the friction between the print wire 6 and the guide members is always constant and thus the printing operation can be carried out in a stable manner as well as at high speed. Furthermore, the whole of the wire printer is compact as the rear ends of print wires 6 and the corresponding electromagnet devices are arranged zig-zag as abovementioned.

What is claimed is:

1. A wire printer comprising:

a base frame over which paper to be printed on advances in use;

a carriage movable over said base frame in a direction transverse to the direction of advance of the paper to be printed on, said carriage including a plurality of guide members equispaced along the direction of movement of said carriage;

a plurality of print wires each having a respective front and rear end, mounting means on said carriage slidably mounting the front and rear ends of said print wires on said carriage with the respective front ends of said print wires equispaced along the direction of movement of said carriage opposite the paper to be printed on, and said plurality of guide members of said carriage being positioned each for slidably supporting and maintaining a portion of a respective print wire intermediate its front and rear ends straight, wherein the number of print wires is equal to a submultiple of a total number of characters to be printed in a line of printing;

a plurality of stationary electromagnet devices on said base frame each for driving a print wire independently of the other electromagnet devices, each electromagnet device comprising a magnetic core having a coil wound thereon and magnetized in response to current flowing through said coil, a print lever displaced by the magnetized core and having a striking portion for striking the rear end of a corresponding print wire when it is displaced at any position to which said carriage moves; and means for reciprocating said carriage in the direction transverse to the direction of advance of the paper to be printed on for a distance approximately corresponding to a space between front ends of adjacent print wires;

whereby energization of selected ones of the stationary electromagnet devices as said carriage is reciprocating in the direction transverse to the direction of advance of the paper to be printed on is effective for printing selected characters in use on the paper.

2. A wire printer according to claim 1, wherein said guide members are positioned to slidably support said print wires with the front ends of said print wires aligned along a row and with the back ends of said print wires aligned along a plurality of rows.

* * * * *